US008083620B2

(12) United States Patent
Sims et al.

(10) Patent No.: US 8,083,620 B2
(45) Date of Patent: Dec. 27, 2011

(54) BALL BATS

(75) Inventors: Steven C. Sims, Shelton, WA (US); Gary Sims, Shelton, WA (US); Greg Winters, Shelton, WA (US); Jonathan F. Seil, Shelton, WA (US)

(73) Assignee: Sims Vibration Laboratory, Inc., Shelton, WA (US)

( * ) Notice: Subject to any disclaimer, the term of this patent is extended or adjusted under 35 U.S.C. 154(b) by 0 days.

(21) Appl. No.: 13/066,109

(22) Filed: Apr. 6, 2011

(65) Prior Publication Data

US 2011/0281673 A1 Nov. 17, 2011

Related U.S. Application Data

(63) Continuation of application No. 12/655,632, filed on Jan. 4, 2010, now abandoned.

(51) Int. Cl.
*A63B 59/06* (2006.01)

(52) U.S. Cl. ..... 473/568; 473/566; 473/520

(58) Field of Classification Search ..... 473/457, 473/519, 520, 564–568
See application file for complete search history.

(56) References Cited

U.S. PATENT DOCUMENTS

| | | | | | |
|---|---|---|---|---|---|
| 2,659,605 | A | * | 11/1953 | Letourneau | 473/568 |
| 3,489,031 | A | * | 1/1970 | Meier | 74/558 |
| D245,443 | S | * | 8/1977 | Sweet | D21/756 |
| 4,660,832 | A | * | 4/1987 | Shomo | 16/431 |
| 4,951,948 | A | * | 8/1990 | Peng | 473/520 |
| D312,563 | S | * | 12/1990 | Hillinger | D8/82 |
| 5,011,145 | A | * | 4/1991 | Bartkowicz | 473/568 |
| 5,042,804 | A | * | 8/1991 | Uke et al. | 473/538 |
| 5,171,011 | A | * | 12/1992 | Squadroni | 473/519 |
| 5,180,163 | A | * | 1/1993 | Lanctot et al. | 473/520 |
| 5,219,164 | A | * | 6/1993 | Peng | 473/520 |
| 5,322,280 | A | * | 6/1994 | Wu | 473/523 |
| 5,322,289 | A | * | 6/1994 | Abrams et al. | 473/202 |
| RE34,767 | E | * | 10/1994 | Soong | 473/300 |
| 5,362,046 | A | * | 11/1994 | Sims | 473/300 |
| 5,380,003 | A | * | 1/1995 | Lanctot | 473/520 |
| 5,575,722 | A | * | 11/1996 | Saia et al. | 473/300 |
| 5,730,662 | A | * | 3/1998 | Rens | 473/300 |
| 5,772,541 | A | * | 6/1998 | Buiatti | 473/520 |
| 5,897,448 | A | * | 4/1999 | Chang | 473/552 |
| 5,910,054 | A | * | 6/1999 | Huang | 473/302 |
| 6,007,439 | A | * | 12/1999 | MacKay, Jr. | 473/520 |
| 6,086,490 | A | * | 7/2000 | Spangler et al. | 473/564 |
| 6,530,852 | B2 | * | 3/2003 | Rios | 473/566 |
| 6,652,398 | B2 | * | 11/2003 | Falone et al. | 473/568 |

(Continued)

*Primary Examiner* — Mark Graham
(74) *Attorney, Agent, or Firm* — Richard D. Multer

(57) ABSTRACT

Ball bats comprising a stem and a handle surrounding the stem. An elastomeric decoupler system installed in the handle sharply reduces the transmission of shocks and vibrations from the stem to the handle, mitigating stinging and other unpleasant sensations experienced by the batter when a ball is struck. Unpleasant sensations can be further reduced by installing a DTMS damping device in the knob of the bat and by installing an elastomeric grip on the handle of the bat; and the unpleasant sound made when a bat strikes the ground or the like can be materially reduced by a device attached to the stem of the bat intermediate the ends of the handle. The present inventions are particularly adaptable to hollow, metal bats; and provision is made for venting the knob of the bat when it is welded in place so hot gases will not be forced into, and reduce the integrity of, the weld. Appropriate ones of the devices described above may also advantageously be employed in wood, composite, and other bats.

10 Claims, 9 Drawing Sheets

U.S. PATENT DOCUMENTS 6,783,471 B2 * 8/2004 Bolduc et al. ..... 473/457
6,821,218 B2 * 11/2004 Byrne et al. ..... 473/568
6,863,628 B1 * 3/2005 Brandt ..... 473/520
6,991,551 B2 * 1/2006 Tolentino et al. ..... 473/167
7,044,871 B2 * 5/2006 Sutherland et al. ..... 473/564
D561,281 S * 2/2008 Sims et al. ..... D21/756

* cited by examiner

BALL BATS

CROSS REFERENCES TO RELATED APPLICATIONS

This application is a continuation of application Ser. No. 12/655,632 filed 4 Jan. 2010, abandoned. Application Ser. No. 12/655,632 is with application Ser. No. 11/880,482 filed 19 Jul. 2007, abandoned; and that application is with provisional applications Nos. 60/832,527 filed 20 Jul. 2006; 60/832,556 filed 20 Jul. 2006; 60/832,562 filed 20 Jul. 2006; and 60/837,904 filed 14 Aug. 2006. The benefits of the filing dates of the above-cited applications are claimed.

TECHNICAL FIELD OF THE INVENTION

The present invention relates to bats and, more particularly, to bats with components for:

(a) protecting a batter against sting and other unpleasant sensations by isolating the handle of the bat from shocks and vibrations set up in the bat when a ball is struck, and/or (b) reducing to an unobjectionable level the unpleasant sound made when a bat is struck against a ball or a hard surface.

BACKGROUND OF THE INVENTION

A host of ball bats with shock and vibration damping and sound-arresting features have been invented and made commercially available and/or described in the patent literature. Among the U.S. patents disclosing such bats are U.S. Pat. Nos. 3,703,290 to Wilson: 3,727,295 to Gildemeister. 3,811, 596 to Wilson: 3,861,682 to Fujir, 3,941,380 to Lacoste: 5,180,163 to Lanctoi et al. 5,219,164 to MacKay. Jr.; 5,931, 750 to MacKay. Jr.; 6,872,157 to Falone. et al. 5,785,617 to MacKay. Jr.: 6,007,439 to MacKay. Jr.; and 7,004,871 to Sutherland, et al.

Notwithstanding all of the effort that has been devoted to shock/vibration damping and sound reduction, there is a continuing and existent demand for bats which exhibit improved performance in these areas.

SUMMARY OF THE INVENTION

Such bats have now been invented, and they are disclosed herein. A number of the novel features disclosed herein may be employed alone and in various combinations to provide shock/vibration damping and noise reduction.

One such, highly effective approach to isolation from shock and noise reduction utilizes: (a) a component which has a barrel and an integrated stem axially aligned with the barrel; (b) a floating handle which surrounds and extends along the stem and may lap onto a transition section between the stem and the barrel of the bat, and (c) a system which floats the handle and isolates a user's hands from the shock waves set up in the bat when it strikes a ball or a playing field or other surface. This system comprises one or more elastomeric decouplers (or isolators) installed between the stem and handle of the bat. Isolation from shock and noise reduction are accomplished by virtue of the system reducing the amplitude, and shortening the decay time, of the shock wave(s) by deflection. This term embraces the interrelated flexing of the bat stem and/or bat handle when a ball or surface is struck; the subsequent elastic restoration of those bat components to "at rest" configurations; and the stretching, twisting, elongation, bending, compression, and other motions of the decoupler(s) and bat stem and handle. Deflection dissipates shock wave energy which would otherwise reach the bat handle and then a user's hands.

A separate damper component may optionally be secured around the stem of the bat at a location between the ends of the bat handle to reduce the sound made when the bat is struck against a hard surface.

A DTMS damper embodying the principles of the present invention and employed alone, or in combination with either or both of the previously described damping mechanisms, is designed for bats which have a stem and a hollow knob at the proximate end of the stem. This damping mechanism has a head in the knob of the bat and may have an integral stem segment which extends into the stem of the bat.

The DTMS damper shortens the decay time of shock and vibrations set up in the bat, which reduces the discomfort experienced by a user by shortening the time for which an unpleasant sensation lasts.

It is important that the head of the DTMS damper be so positioned in the knob that the peripheral portions of the damper head are free to move in all directions in the knob of the bat without striking the inner surfaces of the knob. This may be accomplished, as examples only, by: (a) providing stand-off spacers on the head-facing top wall of the knob or by pinning the stem of the damper to the stem of the bat; (b) sizing the damper head and knob to provide a gap between the head and the side wall of the knob; and (c) tapering the underside of the damper head so that the head will not strike the bottom wall of the knob as the peripheral edge portions of the head move in the knob.

A pressure relief system keeps hot gases generated in the knob as the knob is welded onto the stem of the bat from being pressurized, forced into, and weakening the weld.

Yet another shock/vibration damping mechanism that can be used for the purposes disclosed herein either alone, or in combination with one or more of the other novel devices disclosed herein, is an elastomeric, progressive resistance wrap for the handle of the bat. This component has pillars protruding from one side of an integral substrate (or base). Optional recesses in the pillars open onto the exposed (or free) ends of the pillars. This gives the wrap a grip akin to that afforded by an octopus tentacle, a desirable attribute enhanced by a tendency of the "hollowed out" pillars to conform to the batter's hands. In addition, the hollowing out of the pillars may allow the pillars to compress and otherwise distort more rapidly with a consequent increase in damping effectiveness, a goal which is further promoted by pneumatic cushioning attributable to air trapped in the recesses of the pillars by a batter's hands.

The objects, features, and advantages of the invention will be apparent to the reader from the foregoing and the appended claims and as the ensuing detailed discussion and description proceeds in conjunction with the accompanying drawings.

DETAILED DESCRIPTION OF THE INVENTION

Figure 1:
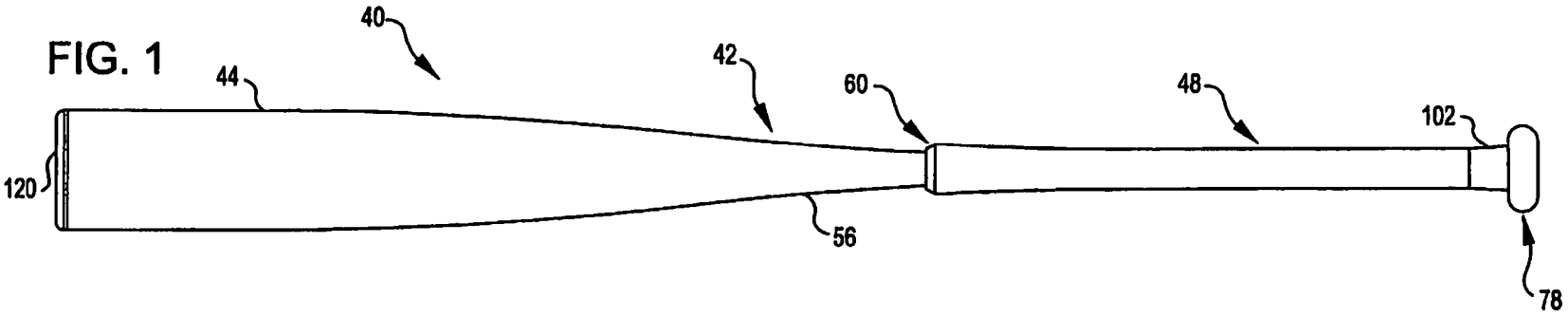
FIG. 1 is a side view of a bat embodying the principles of the present invention.

Referring now to the drawings, FIGS. 1-6 depict a bat 40 constructed in accord with, and embodying, the principles of the present invention.

The major components of bat 40 include a component 42 which comprises a hollow barrel 44 and an integral, hollow stem 46 extending from, and axially aligned with, barrel 44. Component 42 can be fabricated from an aluminum, titanium, or other alloy or from any appropriate composite; for example, a polymeric material reinforced with glass-carbon fibers.

The stem 46 of bat 40 is surrounded by a handle 48. The handle extends from an end 50 near the proximate end 52 of stem 46 past the distal end 54 of the stem and laps onto the transition section 56 of barrel 44. Handle 48 may, but does not necessarily have to be, fabricated from a glass, carbon, or glass-carbon composite.

Annular, elastomeric decouplers 58 and 60 are installed between bat handle 48 and stem-barrel component 42 at opposite, proximate and distal ends 50 and 64 of the handle. The decouplers isolate handle 48 from barrel/stem component 42, keeping shock (and to a significant extent other vibrations) from being transmitted to the batter's hands when a ball is struck. Consequently, the batter is not stung or otherwise subjected to pain or discomfort. This is per se advantageous and also improves performance by keeping the batter from flinching when swinging at a ball.

Decoupler 58 has a rectangular cross-section, and decoupler 60 has a similar configuration with an integral, tapered projection 65 at an exposed end of that decoupler. Projection 65 engages and covers the distal end 64 of handle 48; and the exposed, tapered, transition surface of the projection enhances the appearance of bat 40 by covering up the end 64 of the handle and by providing an aesthetically-pleasing transition from the handle to the barrel 44 of the bat. As discussed above, it is not essential that the illustrated arrangement of two decouplers, one located at each end of the bat handle 48 be employed. The decouplers can be spaced inwardly from the ends of handle 48. Three or more decouplers spaced along the handle can be employed, as can a single decoupler long enough to span an appreciable length of the handle.

Figure 7:
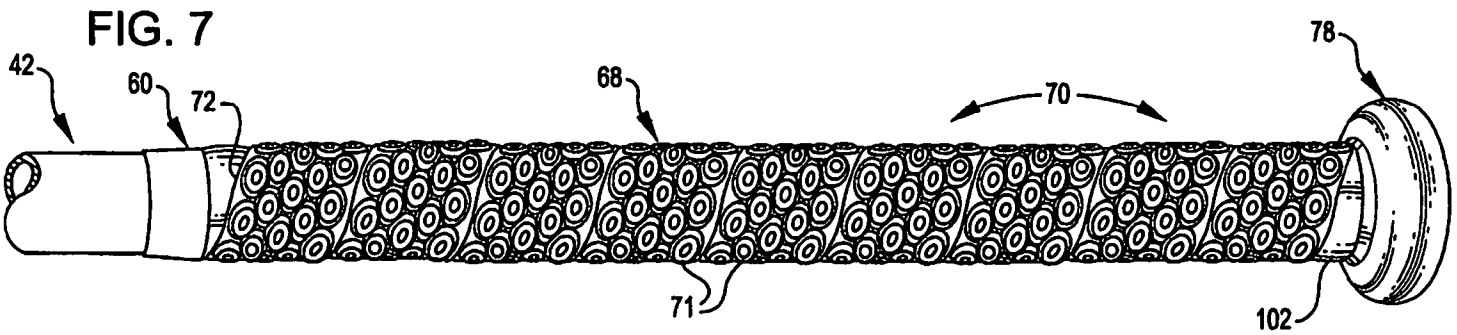
FIG. 7 is a fragmentary perspective of the FIG. 1 bat with an elastomeric wrap installed on the handle of the bat.
Figure 8:
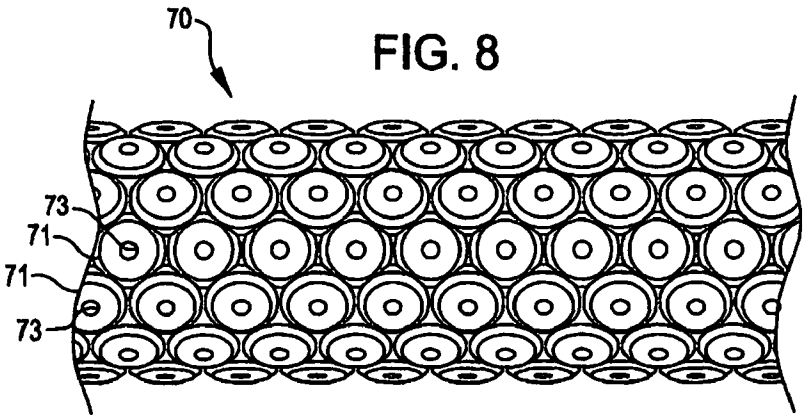
FIG. 8 is an enlarged scale fragment of FIG. 7.
Figure 9:
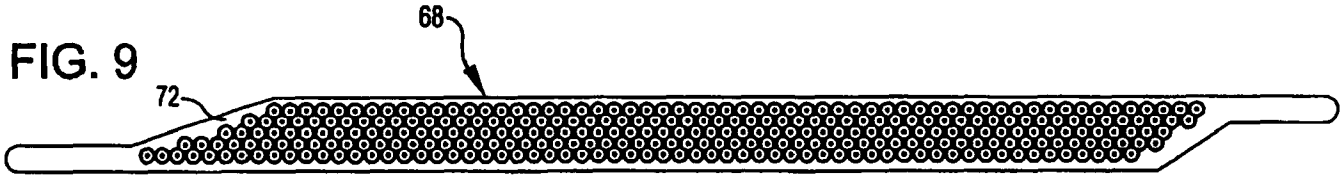
FIG. 9 is a plan view of the FIG. 7 wrap.
Figure 10:
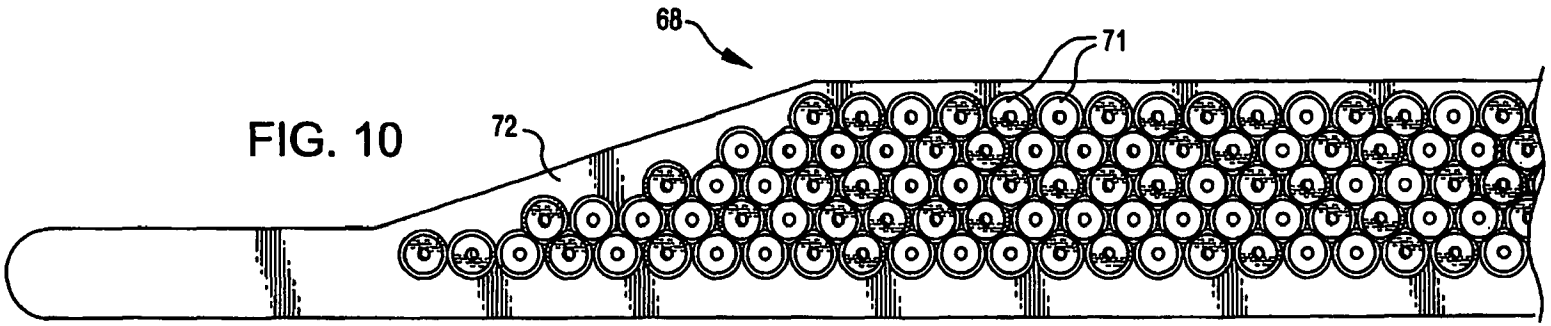
FIG. 10 is an enlarged scale fragment of FIG. 9.

As is shown in FIGS. 7 and 8, the handle 48 of bat 40 may be surrounded with an elastomeric wrap 68 to further block the transmission of deleterious vibrations from bat 40 to a batter's hands. Wrap 68, best shown in FIGS. 7 and 9, is trained around bat handle 48 in helical fashion to form the grip 70 shown in FIG. 7.

The adverse effects of shock/vibration phenomena such as noise production and the minimization of discomfort can be materially reduced by shortening shock/vibration decay times. Because grip 70 is manufactured from a NAVCOM® or other suitable elastomeric material, energy transmitted to the bat handle 48 is dissipated by the stretching, bending, and other distortions of the device as it is impacted by shock/vibration. These physical, three-dimensional, elastic motions of the device—collectively referred to by the judicially approved and construed term "wiggle and jiggle"—significantly shorten the shock/vibration decay time, making the dissipation of shock/vibration impact energy remarkably efficient.

A significant gain in performance is achieved by the use of progressive resistance technology in wrap 68. To this end, integral pillars 71 are formed on the exposed side of wrap substrate 72. Continued deformation of the pillars results in progressively increasing resistance of the elastomeric material, significantly enhancing the shock/vibration damping performance of grip 70.

The pillars 71 may have the illustrated circular or an elliptical, square, triangular, or other configuration; and a combination of configurations can be employed in the same wrap. A strictly optional recess 73 is formed in each integral pillar of the exemplary wrap 68. At one end, the recess opens onto that exposed end of the node opposite the substrate. The recess may extend through the substrate and open onto its opposite face, or it may have a blind inner end. Each pillar may have multiple open-ended recesses, and they may be of the through-bore or blind-end type or a mixture of those types.

Vibration decay time modification leading to significantly shorter vibration/shock decay times and consequent mitigation of unwanted effects such as the prolonged stinging of a batters hands is attributable to the novel pillars 71 discussed above. When a ball is struck and pressure is consequentially exerted on grip 70, pillars 71 rapidly compress, deflect, and otherwise distort and offer progressively increased resistance to such motions. It is this rapid, progressive resistance and elastic deflection and distortion, bending, compression and stretching in combination with similar actions of substrate 72 that gives grip 70 its unique ability to mitigate the unwanted, adverse effects of vibrations and shocks.

Grasping grip 70 produces suction akin to that of an octopus tentacle, improving the grasp of the bat afforded by the grip. The grasp is further enhanced by virtue of grip 70 conforming to the contour of the batters hand due to that enhanced ability of the nodes 71 to deform and deflect attributable to the "hollowing out" of the pillars by the recesses in those elements.

Figure 2:
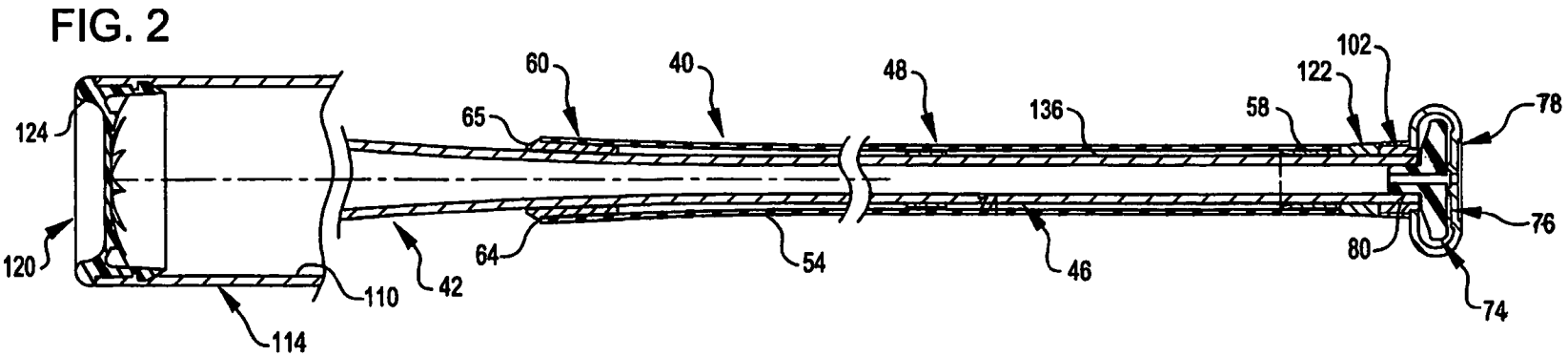
FIG. 2 is a longitudinal section through the FIG. 1 bat.
Figure 3:
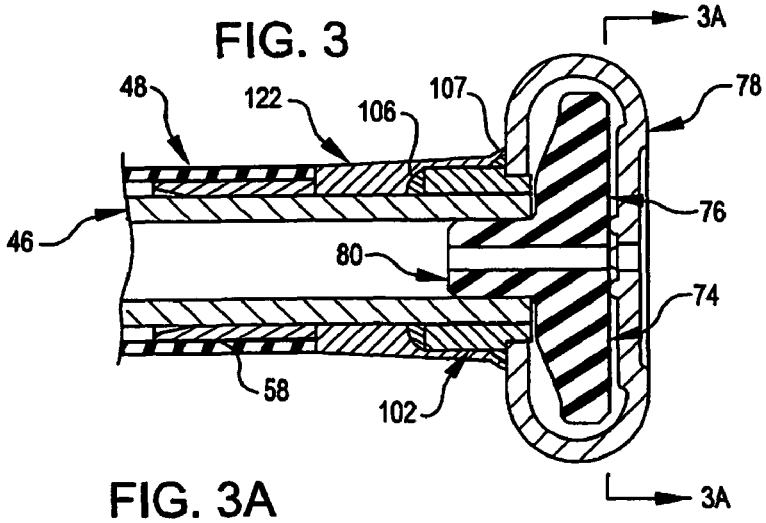
FIG. 3 is an enlarged scale fragment of FIG. 2.

Another device that can be used independently, or with any or all of the other damper devices disclosed herein, to keep a batter from experiencing pain or discomfort when a ball is struck is the elastomeric DTMS damper illustrated in FIGS. 2 and 3 and identified by reference character 74. Damper 74 does not effect the amplitude of shock and vibrations set up in bat 40, but does significantly shorten the decay times of those shocks and vibrations. As discussed above, this is beneficial because this shortens the time for which pain or other discomfort is felt by the user, and such discomfort rapidly increases with time even though the magnitude of the transmitted shock or vibrations remains the same.

Damper 74 has a head 76 in the hollow knob 78 at the proximate end 52 of bat stem 46 and an integral damper stem 80 in the same end 52 of the bat stem.

It is important that the peripheral portion 81 of DTMS damper head 76 be free of contact with the top, bottom, and side walls 82, 83 and 84 of knob 78 so the peripheral head portion can bend, stretch, flex, and otherwise wiggle and jiggle to shorten the decay times of shock and vibrations set up in the barrel/stem component 42 of bat 40 and transferred to DIMS damper 74 when a ball is struck and thus alleviate the discomfort a batter might otherwise experience. In the lateral or transverse direction this is accomplished so dimensioning damper head 76 relative to knob 78 as to provide a 360° gap 86 between the periphery 88 of damper head 76 and the side wall 84 of knob 78.

The requisite clearance between the damper head edge portion 81 and the bottom wall 83 of knob 78 is obtained by tapering the under side 90 of damper head peripheral edge portion 81 from the inner boundary 92 of the edge portion to a location 94 near the periphery 88 of the head as is best shown in FIG. 3

Figure 3A:
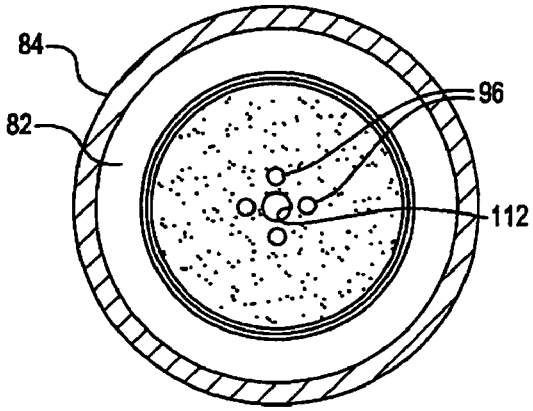
FIG. 3A is a view looking in the direction of arrows 3A-3A in FIG. 3.

DTMS damper head 76 is kept free of knob top wall 82 by integral dimple elements 96 extending inwardly from the top knob wall 82 into contact with the upper side 98 of damper head 76. These stand-off elements 96 are symmetrically spaced around, and near, the axial centerline 100 of DIMS damper 74 (see FIG. 3A). Thus, they do not in any way interfere with the shock and vibration damping movements of damper head peripheral edge portion 81.

Figure 3B:
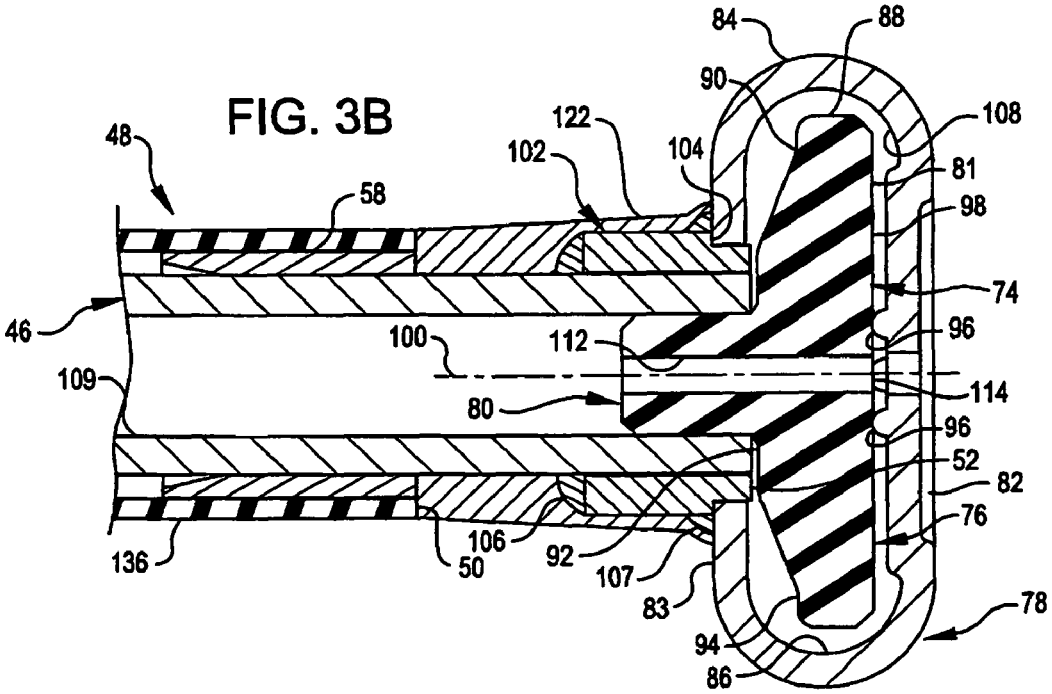
FIG. 3B is an enlarged scale detail of the structures shown in FIG. 3.

Knob 78 is assembled to the stem 46 of bat 40 by first welding an annular, shouldered attachment sleeve 102 to the proximate end 52 of the stem. Next, the knob 78 is slid onto attachment sleeve 102 until the bottom wall 83 of knob 78 butts against the shoulder 104 on sleeve 102. The bottom knob wall 83 is welded to sleeve 102. The welds are identified by reference characters 106 and 107 in FIG. 3B.

The heat generated in the welding step raises the pressure on the air trapped In the hollow interior 108 of knob 78 by the stem 80 of DTMS damper 74. Unless relieved, this pressure would force air from the knob interior into welds 106 and/or 107, introducing porosity into and thereby weakening the welds.

In accord with the present invention, the pressure may be relieved by venting the trapped air into the very large volume provided by the hollow interior 109 of bat stem 46 and the even larger volume provided by the communicating hollow interior 110 of barrel 44. Specifically, the interior 108 of knob 78 is vented through centrally located, longitudinal vent passage 112 which extends seriatim through the head 76 and stem 80 of DTMS damper 74. One end 114 of vent passage 112 opens onto the interior 108 of knob 78, and the opposite end 116 of the passage opens onto the hollow interior 109 of bat stem 46. Thus, and because of the above-discussed spaces between the external surfaces of DTMS damper head 76 and the facing surfaces of damper walls 82, 83 and 84, the entire interior 108 of knob 78 is communicated with the large volume encompassed by bat stem and barrel interiors 109 and 110, and the forcing of strength-reducing air into weld 106 is avoided.

Figure 4:
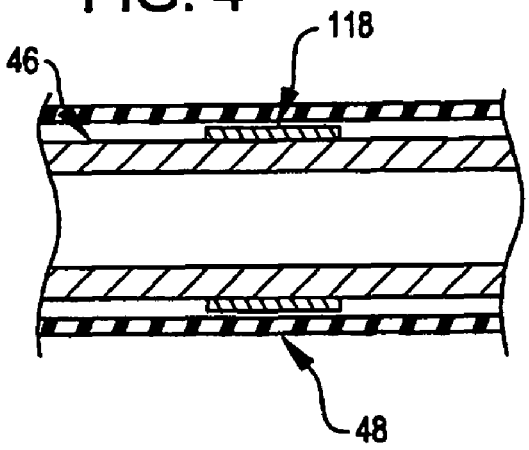
FIG. 4 is a second enlarged scale fragment of FIG. 2.
Figure 5:
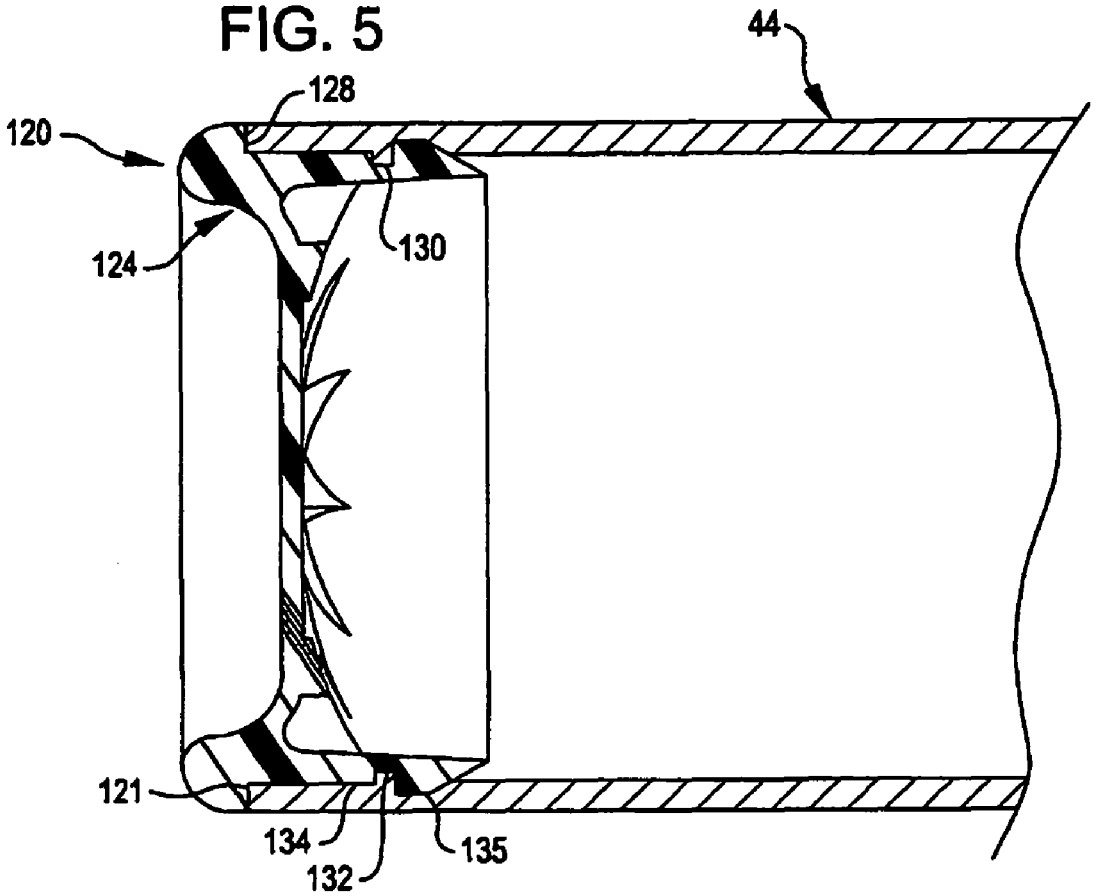
FIG. 5 is an enlarged view of the barrel end of the FIG. 1 bat.
Figure 6:
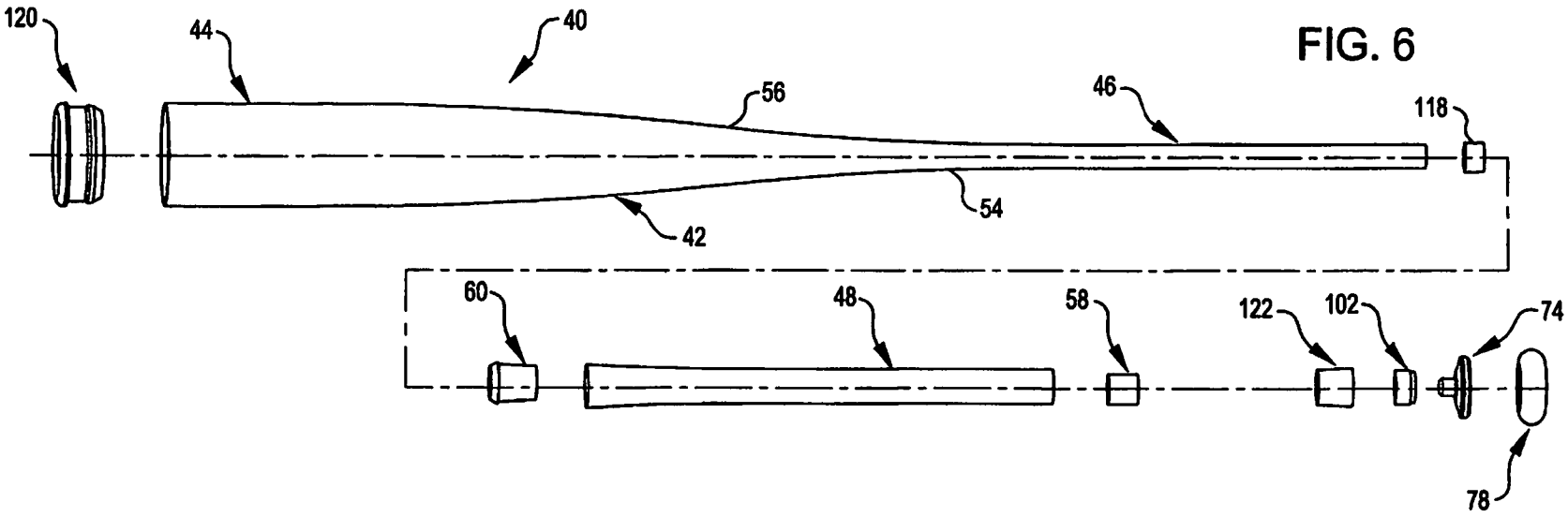
FIG. 6 is an exploded view of the FIG. 1 bat.

A loud, unpleasant sound may be generated when a bat as disclosed herein strikes a batter is rapped on the ground or other hard surface by virtue of the bat stem and bat handle flexing and coming into contact. It has been found that this sound can be reduced to an unobjectionable level by installing a sound-deadening buffer on the stem of the bat approximately midway between the ends of the bat handle. Bat 40 is equipped with an annular buffer 118 of this character. As shown in FIG. 4, buffer 118 surrounds stem 46. It is preferably fabricated from a NAVCOM® or other elastically deformable material with a sound damping capability and can be adhesively attached to the stem or held in place by friction. The thickness of buffer 118 is so selected as to leave a flexure accommodating space between the buffer and the handle 48 of bat 40.

In addition to the components discussed above, bat 40 has a barrel cap 120 and a tubular, handle end spacer 122.

Barrel cap 120 is installed in the open, distal end 121 of barrel 44. The end cap has a top wall 124 with a dished configuration and a circumferential ledge 128 which butts against distal barrel end 121. A boss 130 on the inside of barrel 44 snaps into a complementary groove 132 in an integral, cylindrical side wall 134 of end cap 120 to retain the end cap in place, a goal furthered by bat groove/end cap lug set 135.

Spacer 122 surrounds the stem 46 of bat 40 and extends between: (a) the proximate end 64 of bat handle 48 and elastomeric decoupler 58, and (b) the bottom wall 83 of knob 78. The spacer overlaps that part of attachment sleeve 102 lying beyond the bottom knob wall.

Spacer 122 completes the continuity of the outer bat handle surface 136. This makes bat 40 comfortable to grip and, also, imparts an aesthetically-pleasing, finished appearance to the bat.

It was pointed out above that, for a knob-housed DTMS damper to function properly, the peripheral edge portion of the damper head must be able to move freely in the knob in which it is installed. This requires that the head of the damper be isolated from the facing top wall of the knob. As was also discussed above in conjunction with bat 40, this can be accomplished by providing a set of stand-off, gap-providing projections or dimples on the top wall of the knob. These dimples engage the facing surface of the damper head, spacing that damper element from the knob.

Figure 11:
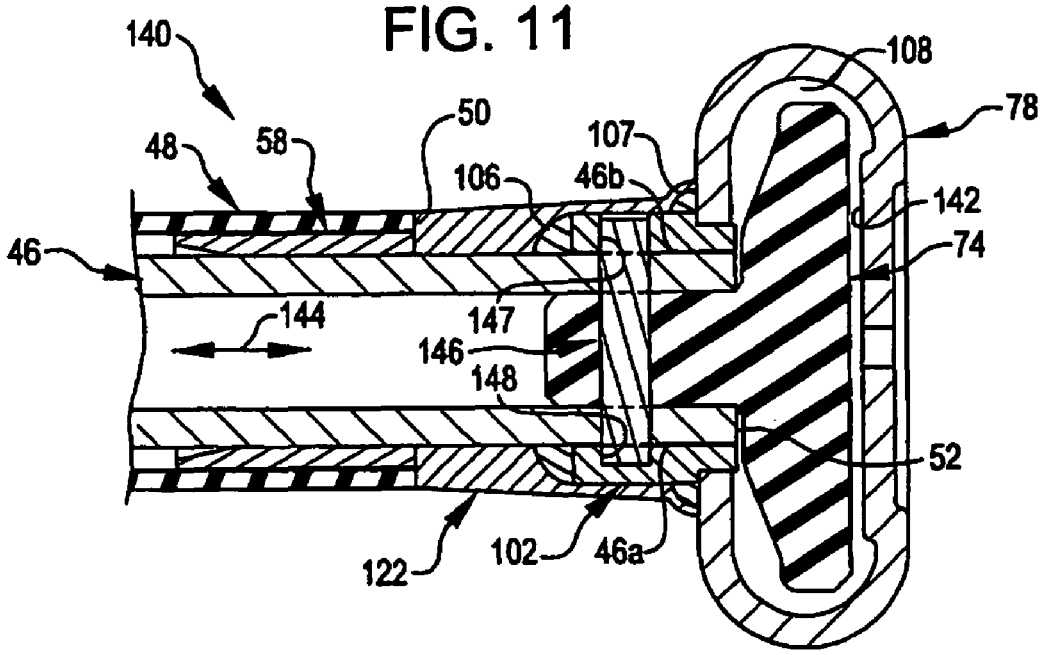
FIGS. 11 and 12 are fragmentary sections through the handle ends of second and third bats embodying the principles of the present invention.

An alternate technique for spacing the damper head from the facing top wall of the knob is illustrated in FIG. 11.

In describing the FIG. 11 embodiment of the present invention and in the descriptions of additional embodiments which follow, common elements and components are identified by the same reference characters.

In the bat 140 depicted in FIG. 11, a gap 142 between the upper side 98 of DTMS damper head 76 and the top wall 82 of knob 78 is maintained by fixing damper 74 against longitudinal, arrow 144 directions of movement relative to the knob. This is accomplished by a pin 146 which extends transversely through the stem 80 of damper 74 and opposite side wall segments 46*a* and 46*b* of bat stem 46. Pin 146 is installed through an aperture 147 in knob attachment sleeve 102 and is seated in a blind aperture 148 on the opposite side of the sleeve. Friction and/or spacer 122 retain pin 146 in place.

As knob 78 is fixed relative to stem 46 by weld 106, pin 146 consequentially fixes the head 76 of damper 74 in the desired, spaced relationship to the knob top wall 82.

It was also pointed out above that knob 78 is assembled by welding it to an also welded in place stem-supported attachment sleeve and that the hollow interior of the knob is vented to keep hot gases generated in the welding steps from being forced into and weakening the welds. In that embodiment of the invention described above and realized in bat 40, this is accomplished by venting space 108 to the communicating, large volume, hollow interiors of the bat stem 46 and bat barrel 44.

In the bat 140 shown in FIG. 11, space 108 is instead vented directly to the surrounding environment through an aperture 149 in the top wall 82 of the knob.

Figure 12:
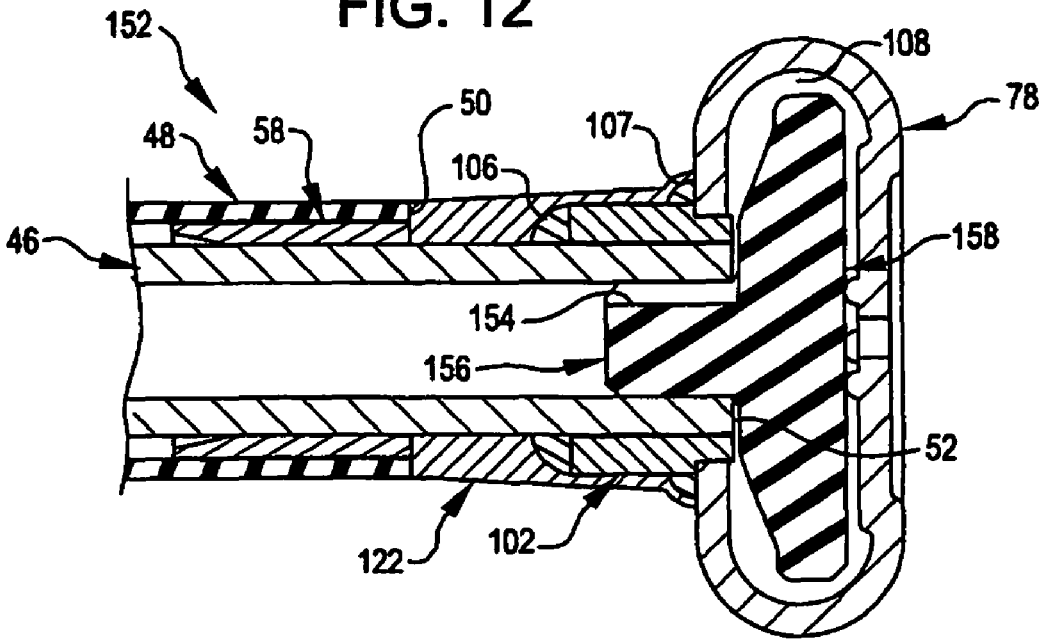

A bat with yet another arrangement for venting the knob is depicted in FIG. 12 and identified by reference character 152. In this bat, a peripheral slot 154 extends the length of the stem 156 of DTMS damper 158. This slot and bat stem 46 define a passageway between the interior 108 of knob 76 and the hollow interior 109 of bat stem 46 through which air can escape into the stem and communicating barrel of the bat as the temperature in knob interior 108 increases.

Figure 17:
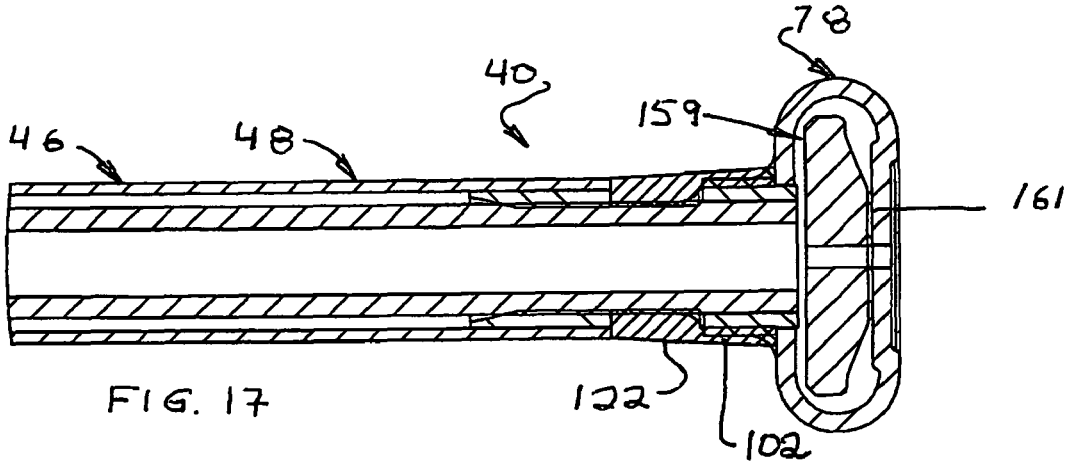
FIG. 17 is a fragmentary section of a bat which embodies the principles of the present invention and is characterized by a knob-housed DIMS damper which does not have a stem.

It is not essential that a knob-housed DTMS damper have a stem as long as the head of the damper is fixed in place in knob 78. As a single example, FIG. 17 depicts bat 40 with a DTMS damper 159 which is configured like the head 76 of the damper 74 shown in FIG. 3. Damper 159 is fixed in place by a centrally apertured spacer 161 faced on both sides with an appropriate adhesive (not shown).

Figure 13:
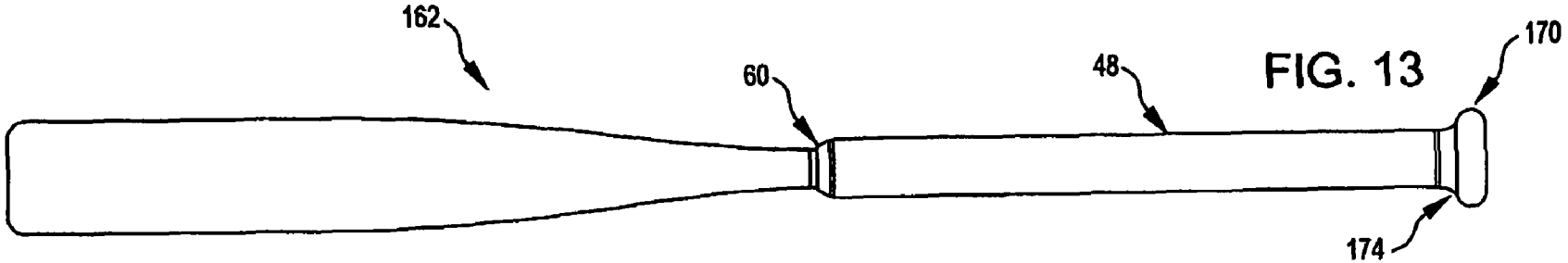
FIG. 13 is a side view of a fourth, wooden bat embodying the principles of the present invention.
Figure 14:
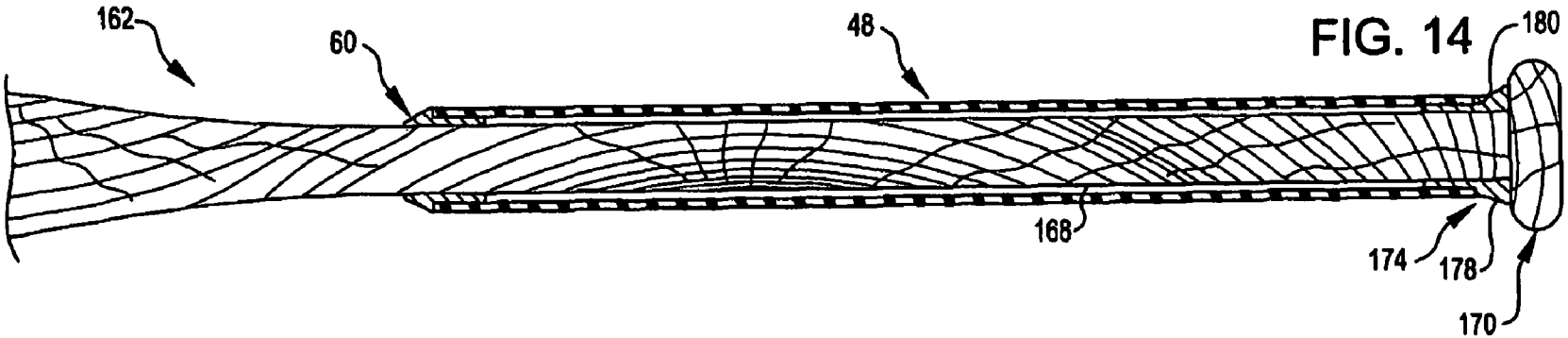
FIG. 14 is a partial longitudinal section through the FIG. 13 bat.

Principles of the present invention can also be employed to advantage in solid, wooden bats as well as in the hollow, metal and composite bats discussed above. An exemplary wooden bat 162 embodying the principles of the present invention is illustrated in FIGS. 13 and 14 and identified by reference character 162. This bat has a barrel 166, a stem 168, and a knob 170. A handle 48 is installed on the stem 168 of the bat and isolated from the stem by elastomeric, distal and proximate end decouplers 60 and 174. Decoupler 60 is discussed above. Decoupler 174 is installed in the proximate end 50 of handle 48. It has a segment 178 forming a shoulder 180 against which the handle is butted. The enlarged diameter segment 178 of decoupler 174 butts against the knob 170 of bat 162, making the bat comfortable to grip and giving it a finished, aesthetically-pleasing appearance in much the same manner that the above-discussed handle end spacer does.

Decoupler 174 may first be assembled to bat knob 170, and the decoupler with the knob attached then installed between the stem 46 and handle 48 of the bat 174.

It was furthermore pointed out above that enhancements such as a knob-housed DTMS damper and a sound-deadening buffer do not have to be employed in bats constructed in accord with the principles of the present invention. Thus, FIGS. 15 and 16 depict a bat 182 without those features, but with the handle and decoupler arrangement which isolates the batter from shocks and other vibrations set up in the bat when the ball is struck or the bat is rapped against a solid surface.

Bats such as those identified by reference character 40 have a hole 180 in the bottom wall of knob 78. The DTMS damper 74 is installed in knob 78 through that hole. This requires a hole larger than the diameter of bat stem 46, and above-discussed attachment sleeve 102 is employed to fill the gap between stem 46 and the bottom wall 83 of the knob.

Figure 15:
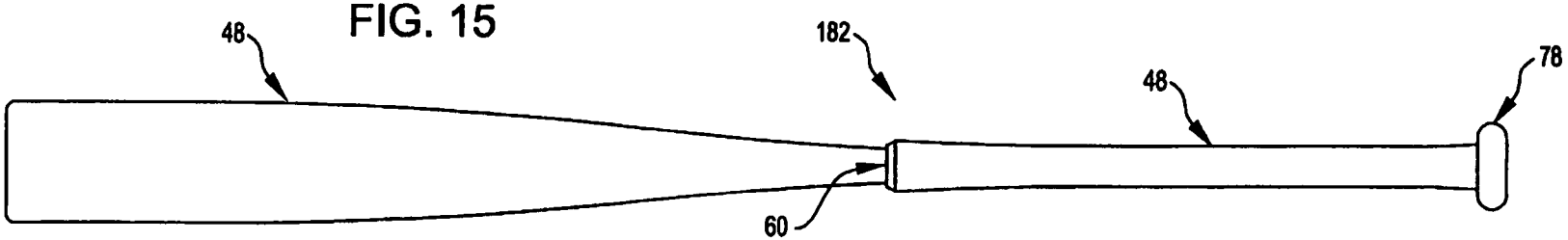
FIG. 15 is a side view of a fifth bat embodying the principles of the present invention.
Figure 16:
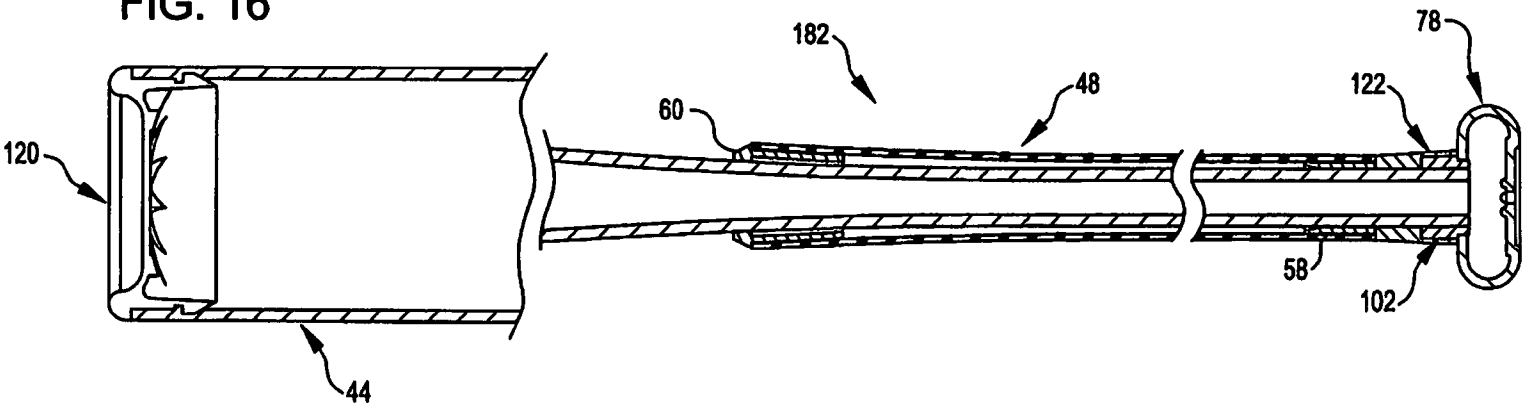
FIG. 16 is a longitudinal section through the FIG. 15 bat.

In those embodiments of the invention which do not employ a knob-housed damper, such as the bat 182 shown in FIGS. 15 and 16, the attachment sleeve can be omitted, the hole in the knob bottom wall 83 sized to closely fit"* stem 46, and the knob welded directly to the bat stem.

Figure 18:
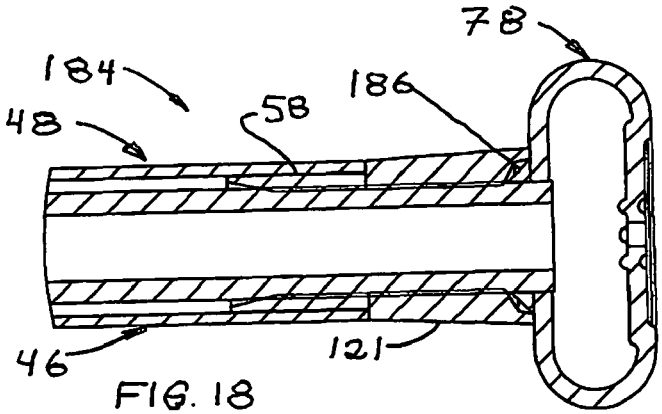
FIG. 18 is a fragmentary section through still another bat which embodies the principles of the present invention; this bat does not have a knob-housed DTMS damper.

A bat so constructed is shown in FIG. 18 and identified by reference character 184. The weld securing knob 78 to bat stem 46 is identified by reference character 186.

The principles of the present invention may be embodied in forms other than those specifically disclosed herein. Therefore, the present embodiments are to be considered in all respects as illustrative and not restrictive, the scope of the invention being indicated by the appended claims rather than by the foregoing description, and all changes which come within the meaning and range of equivalency of the claims are therefore intended to be embraced therein.

The invention claimed is:

1. A bat comprising:

a barrel;

a stem axially aligned in end-to-end relationship with the barrel;

a handle surrounding and spaced from the stem;

a knob assembled to the stem at one end of the stem; and first and second, elastomeric, shock and vibration mitigating/handle suspension devices mounted between the stem and the handle of the bat only at opposite ends of the handle to isolate the handle from shocks and vibrations set up in the barrel of the bat and to support the handle from the stem;

the first of the suspension devices being adjacent, but spaced along the length of, the stem from the knob.

2. A bat as defined in claim 1 which comprises:

the handle;

a grip comprising an array of contiguous, progressive resistance pillars which are fabricated from an elastomeric material;

the grip further comprising a substrate which is fabricated from an elastomeric material and which surrounds and contacts the handle of the bat;

the progressive resistance elements being integral with and protruding from an exposed side of the substrate of the grip; and the progressive resistance elements having the capability of elastically deflecting, bending, compressing, and/or stretching in response to the exertion of pressure on those elements.

3. A bat as defined in claim 2 wherein the pillars have configurations which are regular polygons or ellipses as viewed from exposed ends of the pillars.

4. A bat as defined in claim 1 which further comprises:

a non-adjustable, shock/vibration damper surrounding, and attached directly to, the stem in the handle at a location intermediate opposite ends of the handle;

the damper being: (a) fabricated in its entirety from an elastomeric material, and (b) so dimensioned and configured as to be free of contact with the handle in the absence of a force effecting flexure between the stem and the bat handle.

5. A bat as defined in claim 1 which further comprises:

the barrel having a hollow interior which communicates with a hollow interior of the stem;

the knob having a hollow interior;

a knob attachment component;

an elastomeric shock and vibration decay time shortening device which has an element in the knob;

a weld attaching the knob to the knob attachment component; and a pressure relief system which keeps those gases in the knob that are heated as the weld is made from being forced into and weakening the weld, the pressure relief system: (a) being free of communication with the exterior of the knob and providing fluid communication from the interior of the knob to the communicating hollow interiors of the stem and the barrel; and (b) comprising a discrete passage extending continuously and completely through the decay time shortening device and communicating at its opposite ends with the hollow interior of the knob and the hollow interior of the stem.

6. A bat which comprises:

a barrel;

a hollow stem integrated with and extending axially from the barrel;

a handle surrounding and spaced from the stem; and radially configured, elastomeric, shock and vibration mitigating/handle suspension devices mounted between the stem and the handle of the bat only at opposite ends of the handle to isolate the handle from shocks and vibrations set up in the barrel of the bat and to support the handle from the stem;

a hollow knob mounted to the stem of the bat at a proximate end of the stem;

an elastomeric damper housed in the knob of the bat; and a shock/vibration damping grip surrounding the handle of the bat;

the first of the suspension devices being adjacent, but spaced along the length of, the stem from the knob; and the grip comprising:

a substrate which is fabricated from an elastomeric material and which surrounds and contacts the handle of the bat; and progressive resistance elements integral with and protruding from an exposed side of the substrate;

the progressive resistance elements having the capability of elastically deflecting, bending, compressing, and/or stretching in response to the exertion of pressure on those elements.

7. A bat as defined in claim 6 which further comprises:

the progressive resistance elements comprising an array of contiguous, progressive resistance pillars which are fabricated from an elastomeric material.

8. A bat as defined in claim 7 wherein the pillars have configurations which are regular polygons or ellipses as viewed from exposed ends of the pillars.

9. A bat as defined in claim 6 which further comprises:

a non-adjustable, shock/vibration damper surrounding, and attached directly to, the stem in the handle at a location intermediate opposite ends of the handle;

the damper being: (a) fabricated in its entirety from an elastomeric material, and (b) so dimensioned and configured as to be free of contact with the handle in the absence of a force effecting flexure between the stem and the bat handle.

10. A bat as defined in claim 6:

wherein there is communication between the hollow interior of the stem and the hollow interior of the barrel; and the bat further comprises:

a knob attachment component;

an elastomeric shock and vibration decay time shortening device which has an element in the knob;

a weld attaching the knob to the knob attachment component; and a pressure relief system which keeps those gases in the knob that are heated as the weld is made from being forced into and weakening the weld, the pressure relief system: (a) being free of communication with the exterior of the knob and providing fluid communication from the interior of the knob to the communicating hollow interiors of the bat stem and barrel; and (b) comprising a discrete passage extending continuously and completely through the decay time shortening device and communicating at its opposite ends with the hollow interior of the knob and the hollow interior of the stem.

* * * * *